US005554442A

United States Patent [19]

Matsunaga et al.

[11] Patent Number: 5,554,442

[45] Date of Patent: Sep. 10, 1996

[54] BINDER FIBER AND NONWOVEN FABRICS USING THE FIBER

[75] Inventors: Nobuhiro Matsunaga; Katsuyoshi Niikura, both of Amagasaki, Japan

[73] Assignee: Unitika Ltd., Hyogo, Japan

[21] Appl. No.: 605,456

[22] Filed: Feb. 26, 1996

Related U.S. Application Data

[63] Continuation of Ser. No. 295,753, filed as PCT/JP93/01890, Dec. 24, 1993 published as WO94/16135, Jul. 21, 1994, abandoned.

[30] Foreign Application Priority Data

Jan. 7, 1993 [JP] Japan ..... 5-018173

[51] Int. Cl.[6] ..... D02G 3/00

[52] U.S. Cl. ..... 428/373; 428/374; 428/370; 525/444; 525/437; 528/361; 528/220

[58] Field of Search ..... 428/373, 374, 428/395, 370; 525/437, 444; 528/361, 220

[56] References Cited

U.S. PATENT DOCUMENTS

| | | | |
|---|---|---|---|
| 4,119,609 | 10/1978 | Gergen et al. | 525/437 |
| 4,164,114 | 8/1979 | Yabuki | 57/236 |
| 4,584,353 | 4/1986 | Kobayashi et al. | 525/444 |
| 5,221,730 | 6/1993 | Morris et al. | 525/444 |
| 5,346,970 | 9/1994 | Dashevsky et al. | 525/444 |
| 5,446,109 | 8/1995 | Matsumura | 525/420 |

FOREIGN PATENT DOCUMENTS

| | | |
|---|---|---|
| 2-119866 | 5/1990 | Japan . |
| 5-93317 | 4/1993 | Japan . |
| 5-93318 | 4/1993 | Japan . |
| 5-195407 | 8/1993 | Japan . |
| 5-214648 | 8/1993 | Japan . |
| 5-222656 | 8/1993 | Japan . |
| 6-73611 | 3/1994 | Japan . |

*Primary Examiner*—Newton Edwards
*Attorney, Agent, or Firm*—Barnes, Kisselle, Raisch, Choate, Whittemore & Hulbert, P.C.

[57] ABSTRACT

A nonwoven fabric having good heat bondability which is suitable for use as interlining and cushioning material, and a binder fiber for use in such nonwoven fabric. The binder fiber is a polyester copolymer which includes ε-caprolactone as a polyester component and has a melting point of not less than 100° C. In the nonwoven fabric, principal fibers are bonded by the binder fiber. The nonwoven fabric has soft feel and is highly resistant to flattening during prolonged use or while in use under high temperature atmosphere.

6 Claims, No Drawings

BINDER FIBER AND NONWOVEN FABRICS USING THE FIBER

This application is a continuation of application Ser. No. 08/195,753 filed as PCT/JP93/01890, Dec. 24, 1993 published as WO94/16135, Jul. 21, 1994, now abandoned.

BACKGROUND OF THE INVENTION

The present invention relates to a binder fiber and a nonwoven fabric using the fiber. Nonwoven fabrics using such a fiber are suitable for use especially as cushion material because they are so soft in hand that, even after prolonged use or when used in a high temperature atomosphere, they are unlikely to flatten and not liable to any appreciable decrease in their adhesion strength.

Hitherto, various known types of nonwoven fabrics in which principal fibers are bonded with binder fibers have been used in applications such as filters, interlinings, shoulder paddings, furniture stuffings such as sofa cushion, chair back cushion, and other cushion paddings, and cushion material for beds and automotive seats.

A binder fiber of the type which has hitherto been largely used has its binder component comprised of polyester copolymer including ethylene terephthalate and ethylene isophthalate. This polyester has high rigidity and is a noncrystalline polymer which does not exhibit any definite crystalline melting point but begins to soften at temperatures above the glass transition point (about 65° to 70° C.). Known nonwoven fabrics which are manufactured by subjecting a combination of the principal fiber and the binder fiber to the process of heat bonding have a disadvantage that they lack handle flexibility and feel rather hard. Another disadvantage is that when subjected to repeated compression and/or bending, the nonwoven fabric is liable to joined-spot fracture, resulting in becoming flattened, or that when used in a high temperature atmosphere, the nonwoven fabric is subject to bond deterioration, resulting in deformation of the fabric.

It is also known to use polyurethane foam material largely in applications including furniture stuffings, such as seat and back cushions for sofas and chairs, and cushionings for beds and automotive seats. With polyurethane foams, however, problems have been raised from the standpoints of safety and environmental protection that they produce nitrogen-containing toxic gases when combusted, and that production of such a foam material requires the use of a fluorocarbon gas which may lead to depletion of ozone layer above the atmosphere.

Then, as a material which can replace polyurethane foam, it is conceivable to use a nonwoven fabric formed principally of a polyester fiber. In this regard, several types of nonwoven fabrics have been known including one formed by needling polyester fiber webs; one using polyester fiber and binder fiber components in combination which are fusion bonded into the nonwoven fabric form (as described in, for example, Japanese Patent Application Laid-Open No. 57- 35047); and one using polyester elastomer as a binder component as in the case of aforesaid nonwoven fabric (as described in, for example, Japanese Patent Application Laid-Open No. 4-240219).

Unfortunately, such known polyester nonwoven fabrics also have their own drawbacks. The one made by needling polyester fiber webs is disadvantageous in that some component fibers are likely to fall off or fly away. The one which is intended to overcome this drawback by incorporating binder fibers through heat bonding lacks softness and feels rather hard. Both of these types are likely to flatten due to repetitive compression or under compression in a high temperature atmosphere, and are also liable to deterioration with time in their cushioning properties while in use.

The one incorporating aforementioned polyester elastomer as the binder component is intended to eliminate the shortcomings of known binder fibers. However, the polyester elastomer disclosed in Japanese Patent Application Laid-Open No. 4-240219 is one produced by copolymerization with a poly(alkylene oxide) glycol component so that it is rather liable to heat degradation and is less heat bondable.

DISCLOSURE OF THE INVENTION

It is an object of the present invention to provide a novel binder fiber which eliminates the drawbacks of nonwoven fabrics using such a known binder fiber, including the lack of soft feel and their likeliness to become flattened in a high temperature atmosphere. It is another object of the invention to provide a nonwoven fabric which incorporates the novel binder fiber so that it has soft feel, is unlikely to flatten when used in a high temperature atmosphere, and has good heat bondability.

The present inventors reviewed possibilities of developing such a novel binder fiber and a nonwoven fabric incorporating the same and this led to the present invention.

Accordingly, the present invention provides a binder fiber comprising a polyester copolymer which includes ϵ-caprolactone as a polyester component and has a melting point of not less than 100° C. In one aspect, the invention provides a binder fiber which is a conjugate fiber having a surface, and first and second conjugate components. The first component comprises a polyester copolymer with a melting point of not less than 100° C. At least a portion of the surface of the conjugate fiber is comprised of the polyester copolymer first component, and the polyester copolymer has ϵ-caprolactone as a polyester constituent. The polyester binder fiber of the invention is such that all of its surface, or only a portion of its surface, is comprised of the polyester copolymer first component.

The invention also provides a nonwoven fabric wherein a principal fiber is bonded by a binder fiber, said binder fiber being a polyester copolymer which includes ϵ-caprolactone as a polyester component and has a melting point of not less than 100° C.

The invention will now be described in detail.

The binder fiber of the invention, as above stated, comprises a polyester copolymer which includes ϵ-caprolactone as a polyester component and has a melting point of not less than 100 ° C. Suitable for use as such polyester is one produced by copolymerizing ethylene terephthalate and/or butylene terephthalate with ϵ-caprolactone. In another form, the polyester may be such that the copolymer is further copolymerized with isophthalic acid, 2,6-naphthalenedicarboxylic acid, adipic acid, sebacic acid, ethylene glycol, 1,6-hexanediol, or the like. The proportion of such additive copolymerization component is preferably not more than 20 mol % relative to the unit number of moles of polyester component. The ϵ-caprolactone in the polyester may be such that they are randomly copolymerized with or block copolymerized with other component.

The melting point of the polyester binder fiber according to the invention is not less than 100° C. as above stated, preferably not less than 130° C. A melting point of less than 100° C. is undesirable because a nonwoven fabric using the binder fiber would be likely to become flattened in a high temperature atmosphere, which is very inconvenient when the nonwoven fabric is used in, for example, a chair or automotive seat which is expected to be exposed to the heat of the burning sun. The upper limit of the melting point range is preferably lower by at least 20° C. than the melting point or decomposition point of a principal fiber of the nonwoven fabric.

In particular, a conjugate fiber of the sheath-core type in which the core is polyethylene terephthalate and the sheath is a polyester binder component is preferred from the view points of soft feel and bond strength. When incorporated into a nonwoven fabric, the conjugate fiber provides good shape retention and good hardness under compression.

The polyester binder fiber according to the invention is not particularly limited in fineness, but is preferably of not less than 2 denier but not more than 100 denier. Uses other than nonwoven fabrics of the binder fiber of the invention may include preparation of molding material for automotive door trims and dashboards. For this purpose, binder fibers, cut short, are mixed with wood chip and the mixture is heated and molded into shape. This provides satisfactory moldings which are not liable to deformation in a high temperature atmosphere.

Nextly, nonwoven fabrics in accordance with the present invention will be described.

Fibers suitable for use as principal fibers include synthetic fibers, such as polyester, nylon, acrylic, and polypropylene fibers, semi-synthetic fibers, such as rayon and the like, and natural fibers, such as wool, cotton flax and wood pulp.

In particular, useful polyester fibers are preferably such that they have as their main components, for example, ethylene terephthalate, buthylene terephtarate, ethylene naphthalate, especially ethylene - 2, 6- naphthalate; and from the physical and economical view points, polyethylene terephthalate fibers are especially preferred. It is noted in this connection that any polyester in which other ingredients, such as isophthalic acid, 5-sulfoisophthalic acid, and diethylene glycol, are copolymerized is acceptable insofar as such other ingredients do not affect the properties of the polyester.

Where such synthetic fiber or semi-synthetic fiber as recited above is used as the principal fiber, the fiber may be circular or odd-shaped in sectional configuration or may be hollow or solid.

The fineness of the principal fiber is not particularly limited, and may be defined according to the characteristic requirements of the intended use of the nonwoven fabric. Typically, fibers of 2 to 200 denier are used.

The polyester binder fiber as another component element of any nonwoven fabric according to the present invention has as a binder component a polyester copolymer which includes ϵ-caprolactone as a polyester component and has a melting point of not less than 100° C.

Where the proportion of ϵ-caprolactone as a polyester component is not less than 3 mol % but less than 40 mol %, it is possible to obtain a polyester having substantially no elastomeric property. Where the proportion of ϵ-caprolactone is less than 3 mol %, the resulting polyester is rather hard which leads to the production of a nonwoven fabric having a hard feel. Where the proportion of ϵ-caprolactone is not less than 40 mol %, the resulting polyester has elastomeric properties. The proportion of the polyester binder fiber may be 10 to 70% by weight of the total fiber content of the nonwoven fabric, but may be varied according to the characteristic requirements of the nonwoven fabric for the intended use.

To manufacture a nonwoven fabric in accordance with the invention, the principal fiber and the polyester binder fiber are mixed together in such proportions as are determined according to the intended use or characteristic requirements thereof, and the mixture is passed through a carding engine or the like for being formed into a web. The web is then passed through a heat treating apparatus in which the polyester binder component is melted for enabling the bonding of the principal fiber. For this purpose, needling may be carried out prior to heat treatment. For the purpose of heat treatment, operating apparatus, such as heated flat roller, heated embossing roller, hot air circulation dryer, suction band dryer, suction drum dryer, and yankee drum dryer, may be employed, For such treatment, treatment temperatures and treatment time may be suitably selected according to the melting point of the polyester binder component.

The nonwoven fabrics according to the invention embrace those ranging from a paper-like nonwoven fabric such that webs having a relatively low weight of the order of not more than 50 g/m$^2$ are heat bonded with heated flat rollers and to so-called highloft materials having a thickness of 5 mm to 150 mm and a fiber density of not less than 0.010 g/cm$^3$. The upper limit in thickness is not particularly limited, but a thickness of up to 150 mm is preferred in consideration of such factors as manufacturing equipment, manufacturing cost and ease of handling. Where the nonwoven fabric is used in the form of highloft materials, the fabric preferably has a fiber density of not less than 0.010 g/cm$^3$. If the density is less than 0.010 g/cm$^3$, the nonwoven fabric may be liable to flatten due to repeated compression. The upper limit in density is not particularly defined because it varies depending upon the cushioning property requirements with respect to the nonwoven fabric in the intended use thereof, but preferably the density is up to 0.2 g/cm$^3$ in consideration of such factors as manufacturing equipment and manufacturing cost.

In order to regulate the thickness and density of nonwoven fabrics according to the invention, the weight of webs prior to heat treatment should be properly selected in consideration of possible surface area shrinkage due to heat treatment, and heat treatment should be carried out with a thickness regulator roll incorporated in the heat treatment unit and/or with webs held between plates or wire meshes between which is sandwiched a spacer of a specified gauge.

The nonwoven fabric of the invention has soft feel because the principal fibers are bonded by the polyester binder which is comparatively soft, not liable to thermal degradation and thus has better heat bondability, The bonded portions of the fabric exhibit high adhesion bond and, therefore, are not liable to separation even when repetitively compressed. Therefore, the nonwoven fabric can satisfactorily retain its shape as such and is unlikely to become flattened. Further, the binder component is comprised of a fiber made from a polyester copolymer including ϵ-caprolactone as a polyester component and having a melting point of not less than 100° C. and, therefore, the nonwoven fabric, while in use, is unlikely to be deformed or flattened under compression in a high temperature atmosphere of, for example, about 70° to 80° C. For this reason, when used as interlining or shoulder pad, the nonwoven fabric is unlikely to go out of shape after washing at high temperature. The nonwoven fabric is also suited for use in filter applications which involve filtration of high temperature fluids. When used as fiberfill for cushions, the nonwoven fabric provides good seating comfort because it has soft feel and can absorb possible impacts. Furthermore, the nonwoven fabric is less liable to flatten during prolonged use or under a high temperature atmosphere and, therefore, is suitable for use in applications such as furniture stuffing, cushioning material for beds and automotive seats, and seating mattress, if it is designed to have more than a certain degree of thickness so that it is free of any feel of floor contact. This characteristic feature of the nonwoven fabric, i.e., the fact that the fabric is less liable to flattening or deformation under a high temperature atmosphere, can be advantageously utilized in applications such as automotive vibration absorbing / acoustic insulation flooring, base for molded ceiling, and molded trunk trim parts. In addition, the fact that the nonwoven fabric exhibits high adhesiveness to rayon and pulp and has soft feel indicates that the fabric is suitable for use in applications such as sanitary materials and floppy disk liners. Further, the nonwoven fabric has good heat bonding properties.

The polyester binder fiber as a constituent member of the nonwoven fabric of the invention may be so designed that the proportion of ϵ- caprolactone for copolymerization is not less than 40 mol % but not more than 80 mol % thereby to provide elastomeric properties. This is advantageous when the nonwoven fabric obtained is used as a cushioning material. If the proportion of ϵ- caprolactone for copolymerization is less than 40 mol %, the resulting polyester has no elastomeric property. If the proportion is more than 80 mole %, the melting point of the resulting polyester is unacceptably low so that the nonwoven fabric is very likely to become flattened in a high temperature atmosphere.

In the above mentioned case, polyester fiber is preferably used as the principal fiber for the nonwoven fabric.

The elastomeric properties of the polyester elastomer is preferably such that assuming that the elastomer is made into a drawn yarn, the yarn has an elongation of 70 to 1000% and, at 50% elongation, an elastic recovery of not less than 80% (100% in the case of recovery to the original length, and 0% in the case of non-recovery) or, at 200% elongation, an elastic recovery of not less than 70%.

When a binder fiber having such elastomeric properties is used in making a nonwoven fabric, it is particularly desirable that the nonwoven fabric should have a thickness of not less than 5 mm so that the fabric can retain its cushioning properties as such. The obtained nonwoven fabric is such that polyester fibers with good hardness are bonded by the polyester elastomer which is highly stretchable, less liable to thermal degradation, and highly heat bondable. Therefore, the nonwoven fabric has soft feel, and its bonded portion is not liable to separation because the bonded portion tends to expand and contract when repetitively compressed. Thus, the nonwoven fabric can be satisfactorily retained in shape and is unlikely to become flattened.

DESCRIPTION OF EMBODIMENTS

The invention will now be described in detail with reference to the examples given hereinbelow. It is to be understood, however, that the invention is not limited in any way by the examples.

Physical properties recited in the following examples were evaluated according to the following methods.

(1) Relative Viscosity

Using an equal-quantity mixture by weight of phenol and ethane tetrachloride as solvent, measurement was made with samples having a concentration of 0.5 g/deciliter, at a temperature of 20° C.

(2) Melting Point

Measurement was made using a differential scanning calorimeter, of Perkin-Elmer, Model DBC- 2, at a heating rate of 20° C./min.

(3) Resistance to flattening under Repetitive Compression

Initially, measurement was made of the thickness of the nonwoven fabric. Then, test sample (10 cm×10 cm), held between parallel flat plates, was subjected to 50,000 time repeated compression tests under a load of 15 kg, at the rate of 60 times per minute. Sample thickness after the test was measured. Bulkiness retention C (%) was calculated according to the following equation, which value was taken as a yardstick for resistance to flattening. The greater the value C, the greater is the resistance to flattening.

$$C\,(\%) = \frac{\text{Sample thickness after test (mm)}}{\text{Original sample thickness (mm)}} \times 100$$

(4) Resistance to Flattening under High Temperature Atmosphere

Initially, measurement was made of the thickness of the nonwoven fabric. Then, test sample (10 cm×10 cm), held between parallel flat plates and fixedly compressed to 50% of the initial thickness, was placed in a temperature controlled oven at 70° C. and was allowed to stand for 6 hours. The sample was then removed and disengaged from the parallel flat plates, being then allowed to stand for 80 minutes at ordinary temperature. The sample thickness was measured. Bulkiness retention Cp (%) under high temperature atmosphere was calculated according to the following equation, which value was taken as a yardstick for resistance to flattening.

$$Cp\,(\%) = \frac{\text{Sample thickness after test (mm)}}{\text{Original sample thickness (mm)}} \times 100$$

(5) Soft Feel

Functional tests were made by ten examiners, and evaluation was made according to the following three ratings.

1: soft; 2: ordinary; 3: hard

Example 1

First, an embodiment of the nonwoven fabric according to the invention will be explained.

Copolymerized polyester chips (relative viscosity, 1.34; melting point, 144° C.), as a binder component, which were obtained by compounding 20 mol % of ϵ-caprolactone (ϵ-CL) with ethylene terephthalate and butylene terephthalate (molar ratio of 1/1), and polyethylene terephthalate (PET) chips having a relative viscosity of 1.38, were dried under reduced pressure. Then, these chips were melted using a conventional conjugation melt spinning apparatus, with the copolymerized polyester arranged for the sheath and the PET for the core portion at the conjugation ratio (weight ratio) of 1:1, and at a spinning temperature of 280° C. The chips were thus conjugatedly melt spun to a total discharge of 313 g/min. Strands of the sheath-core structure yarn thus spun were cooled and then taken Up at a take-up speed of 1000 m/min. Thus, strands of undrawn yarn were obtained. The undrawn yarn strands were bundled into a tow of 100,000 denier, which was drawn in a draw ratio of 2.9 at a draw temperature of 60° C. Then, the tow was heat treated on a heated drum at 120° C. Crimps were applied to the drawn tow using an indentation type crimper. The tow was then cut to a length of 51 mm to give a sheath-core type conjugate polyester-based binder fiber having single fiber fineness of 4 denier.

The obtained binder fiber and the PET fiber of a hollow sectional shape (strength 4.0 g/d; elongation 58%, fineness 6 denier; cut length 51 mm, hollowness or proportion of the hollow portion in fiber section 27%) were mixed in a weight ratio of 20: 80. The mixture was passed through a carding engine and the resulting webs were stacked one over another by a cross lapper, being thus formed into a web having a weight of 600 g/m$^2$. This web was passed through a needle locker loom in which needling was carried out with a needle density of 240 needles/cm$^2$. The web was then placed between wire meshes, with a 20 mm thick spacer held therebetween, which was subjected to heat treatment in a hot air circulation dryer at 170° C. for 5 minutes, while being regulated with respect to its thickness. Thus, a nonwoven fabric having a thickness of 20 mm was obtained. This nonwoven fabric had no indication of its binder component having undergone thermal degradation. It was white in color and had soft feel.

EXAMPLE 2

Instead of the copolymerized polyester chips used as a binder component in Example 1 were used a copolymerized polyester chips (relative viscosity 1.34; melting point 182° C.) obtained by compounding 20 mol % of ϵ-CL with polybutylene terephthalate. The temperature for heat treatment of the web was 200° C. instead of 170° C. In other respects, the same procedure as in Example 1 was followed to obtain a nonwoven fabric.

EXAMPLE 3

Instead of the copolymerized polyester chips used as a binder component in Example 1 were used copolymerized polyester chips (relative viscosity 1.40; melting point 195° C.) obtained by compounding 28 mol % of ϵ- CL with polybutylene terephthalate. The temperature used for heat treatment at the heated drum was 150° C. instead of 120° C., and the temperature for heat treatment of the web was 210° C. instead of 170° C. In other respects, the same procedure as in Example 1 was followed to obtain a nonwoven fabric. Despite the fact that higher heat treatment temperatures were used, there was no evidence of the binder component having undergone heat degradation.

EXAMPLE 4

Instead of the copolymerized polyester chips used as a binder component in Example 1 were used a copolymerized polyester chips (relative viscosity 1.36; melting point 113° C.) obtained by compounding 38 mol % of ϵ-CL. The temperature used for heat treatment at the heated drum was 85° C. instead of 120° C., and the temperature for heat treatment of the web was 140° C. instead of 170° C. In other respects, the same procedure as in Example 1 was followed to obtain a nonwoven fabric.

EXAMPLE 5

Instead of the copolymerized polyester chips used as a binder component in Example 1 were used copolymerized polyester chips (relative viscosity 1.44; melting point 171° C.) obtained by compounding 3 mol % of ϵ- CL. The temperature used for heat treatment at the heated drum was 130° C. instead of 120° C., and the temperature for heat treatment of the web was 190° C. instead of 170° C. In other respects, the same procedure as in Example 1 was followed to obtain a nonwoven fabric.

EXAMPLE 6

Instead of the copolymerized polyester chips used as a binder component in Example 1 were used a copolymerized polyester chips (relative viscosity 1.45; melting point 177° C.) obtained by compounding 1 mol % of ϵ- CL. The temperature used for heat treatment at the heated drum was 135° C. instead of 120° C., and the temperature for heat treatment of the web was 195° C. instead of 170° C. In other respects, the same procedure as in Example 1 was followed to obtain a nonwoven fabric.

COMPARATIVE EXAMPLE 1

Instead of the copolymerized polyester chips used as a binder component in Example 1 were used polyester chips (relative viscosity 1.97; melting point 95° C.) obtained by compounding 28 mol % of ethylene terephthalate and butylene terephthalate (acid component molar ratio 6/4) and 72 mol % of ϵ- CL. Drawing was carried out and then heat treatment on heat drum at 80° C. was carried out instead of heat treatment on heated drum at 120° C. Wrappings around the drawing rollers and interfiber adhesion were observed to considerable extent. A sample was obtained, though in small quantity. The sample obtained was used as a binder fiber component. A temperature of 120° C. was used for heat treatment of the web instead of 170° C. In other respect, the same procedure as in Example 1 was followed to obtain a nonwoven fabric.

COMPARATIVE EXAMPLE 2

Instead of the copolymerized polyester chips used as a binder component in Example 1 were used polyester chips (relative viscosity 1.37; visually determined softening point 110° C., no melting point recognized by DSC inspection) composed of ethylene terephthalate and ethylene isophthalate (acid component molar ratio 6/4). Heat treatment by heated drum was not carried out. The temperature used for web heat treatment was 150° C. instead of 170° C. In other respects, the same procedure as in Example 1 was used to obtain a nonwoven fabric.

Evaluation results are shown in Table 1 with respect to characteristic aspects of nonwoven fabrics, such as thickness, density, soft feel, and resistance to flattening, in Examples 1 to 6, and Comparative Examples 1 and 2.

TABLE I

| Example | Thickness | Density | Soft | Flattening Resistance | |
|---|---|---|---|---|---|
| No. | (mm) | (g/cm$^3$) | Feel | C | Cp |
| 1 | 20 | 0.030 | 1 | 90 | 84 |
| 2 | 20 | 0.030 | 1 | 92 | 86 |
| 3 | 20 | 0.030 | 1 | 94 | 87 |
| 4 | 20 | 0.030 | 1 | 91 | 76 |
| 5 | 20 | 0.030 | 2 | 88 | 86 |
| 6 | 20 | 0.030 | 1 | 87 | 84 |
| Cmpr Ex 1 | 20 | 0.030 | 1 | 87 | 56 |
| Cmpr Ex 2 | 20 | 0.030 | 3 | 81 | 53 |

As is apparent from Table 1, nonwoven fabrics of Examples 1 to 4 and 6 were all found satisfactory in both soft feel and resistance to flattening. Nonwoven fabrics in Example 5 exhibited good resistance to flattening, though rated ordinary in soft feel. In contrast to these, the nonwoven fabric of Comparative Example 1 was rated lower in resistance to flattening under high temperature atomosphere because of the lower melting point of the polyester component as the adhesive component. Similarly, the nonwoven fabric in Comparative Example 2 was found unfavorable in flattening resistance under high temperature atomosphere.

COMPARATIVE EXAMPLE 3

Instead of the copolymerized polyester chips used as a binder component in Example 1 were used polyester chips (relative viscosity 1.94; melting point 181° C.) composed of polybutylene terephthalate and polytetramethylene glycol having a molecular weight of 1500 (weight ratio 4/6). The temperature used for heat treatment at the heated drum was 130° C. instead of 120° C., and temperature for heat treatment of the web was 195° C. instead of 170° C. In other respects, the same procedure as in Example 1 was followed. However, the binder component suffered severe thermal degradation and became discolored to brown, being reduced to rags. After all, the web could not be made into a nonwoven fabric.

EXAMPLES 7, 8, 9, 10

For the purpose of varying densities of respective nonwoven fabrics to be obtained, the thickness of the spacer used in Example 1 to regulate web thickness during heat treatment was changed from 20 mm to 8 mm, 35 mm, and 69 mm (respectively for Examples 7, 8 and 9). The weight of web prior to heat treatment which was set at 600 g / $m^2$ in Example 1 was changed to 120 g / $m^2$, and the thickness of the spacer for regulating the thickness of the web during heat treatment was changed to 4 mm (for Example 10). In other respects, the same procedure as in Example 1 was followed to obtain respective nonwoven fabrics.

Evaluation results are shown in Table 2 with respect to characteristic aspects of nonwoven fabrics, such as thickness, density, soft feel, and resistance to flattening in Examples 7, 8, 9 and 10.

TABLE 2

| Example | Thickness | Density | Soft | Flattening Resistance | |
|---|---|---|---|---|---|
| No. | (mm) | (g/cm$^3$) | Feel | C | Cp |
| 7 | 8 | 0.082 | 1 | 99 | 97 |
| 8 | 35 | 0.020 | 1 | 85 | 83 |
| 9 | 69 | 0.009 | 1 | 68 | 65 |
| 10 | 4 | 0.031 | 2 | 19 | 87 |

As is apparent from Table 2, nonwoven fabrics of Examples 7 and 8 were found satisfactory in both soft feel and resistance to flattening. The nonwoven fabric of Example 9 which was of lower density was found to be somewhat liable to flattening but had satisfactory soft feel. The nonwoven fabric of Example 10 which had a thickness of only 4 mm seemed to give some feel of floor contact, but had satisfactory resistance to flattening.

EXAMPLE 11

Nylon 6 fiber (fineness 1.5 denier; cut length 51 mm) was used as principal fiber. As binder fiber was used the fiber obtained in Example 1. The binder fiber and the nylon 6 fiber were mixed in a weight ratio of 20: 80. The mixture was passed through a carding engine and was then made into a web having a weight of 45 g / $m^2$. The web was passed between a heated emboss roller of 150° C. and a flat roller thereby to obtain an embossed nonwoven fabric. When used as clothing interlining, the nonwoven fabric exhibited good performance characteristics, with soft feel and no likelihood of going out of shape during prolonged use.

EXAMPLE 12

Copolymerized polyester chips (relative viscosity 1.84; melting point 184° C.), as a binder component, were obtained by compounding 40 mol % of ethylene terephthalate as hard segment and 60 mol % of ε- CL as soft segment. These polyester chips as the binder component and PET chips having a relative viscosity of 1.38 were dried under reduced pressure. Then, these chips were melted using a conventional conjugation melt spinning apparatus, with the copolymerized polyester arranged for the sheath and the PET for the core at the conjugation ratio (weight ratio) of 1:1, and at a spinning temperature of 280° C. The chips were thus conjugatedly melt spun to a total discharge of 313 g/min. Strands of the sheath-core structure yarn thus spun were cooled and then taken up at a take-up speed of 1000 m min. Thus, strands of undrawn yarn were obtained. The undrawn yarn strands were bundled into a tow of 100,000 denier, which was taken up at a take-up rate of 1000 m / min to give undrawn fiber strands. The obtained yarn strands were bundled into a tow of 100,000 denier, which was drawn in a draw ratio of 2.8 at a draw temperature of 60° C. Then, the tow was heat treated on a heated drum at 140° C. Crimps were applied to the drawn tow using an indentation type crimper. The tow was then cut to a length of 51 mm to give a sheath-core type conjugate polyester binder fiber having single fiber fineness of 4 denier.

The obtained binder fiber and the PET fiber of a hollow sectional shape (strength 4.0 g/d; elongation 58%, fineness 6 denier; cut length 51 mm, hollowness 27%) were mixed in a weight ratio of 20: 80. The mixture was passed through a carding engine and the resulting webs were stacked one over another by a cross lapper, being thus formed into a web having a weight of 600 g/$m^2$. This web was passed through a needle locker loom in which needling was carried out with a needle density of 240 needles/$cm^2$. The web was then placed between wire meshes, with a 20 mm thick spacer held therebetween, which was subjected to heat treatment in a hot air circulation dryer at 200° C. for 5 minutes, while being regulated with respect to its thickness. Thus, a nonwoven fabric having a thickness of 20 mm was obtained. This nonwoven fabric had no indication of its binder component having undergone thermal degradation. It was white in color and had soft feel.

EXAMPLE 13

Instead of the copolymerized polyester chips used in Example 12 were used copolymerized polyester chips (relative viscosity 1.97; melting point 160° C.) obtained by compounding 38 mol % of butylene terephthalate (PBT) as hard segment and 62 mol % of ε- CL as soft segment. The temperature used for heat treatment of the web was 180° C. instead of 200° C. In other respects, the same procedure as in Example 12 was followed to obtain a nonwoven fabric.

EXAMPLE 14

Instead of the copolymerized polyester chips used in Example 13 were used copolymerized polyester chips (relative viscosity 2.07; melting point 137° C.) obtained by compounding 29 mol % of PBT as hard segment and 71 mol % of ϵ- CL as soft segment. The temperature used for heat treatment at the heated drum was 110° C. instead of 140° C., and the temperature for heat treatment of the web was 150° C. instead of 180° C. In other respects, the same procedure as in Example 13 was followed to obtain a nonwoven fabric.

EXAMPLE 15

Instead of the copolymerized polyester chips used in Example 13 were used copolymerized polyester chips (relative viscosity 2.09; melting point 180° C.) obtained by compounding 47 mol % of PBT as hard segment and 53 mol % of ϵ- CL as soft segment. The temperature used for heat treatment of the web was 200° C. instead of 180° C. In other respects, the same procedure as in Example 13 was followed to obtain a nonwoven fabric.

EXAMPLE 16

Instead of the copolymerized polyester chips used in Example 12 were used copolymerized polyester chips (relative viscosity 1.85; melting point 204° C.) obtained by compounding 56 mol % of PBT as hard segment and 44 mol % of ϵ- CL as soft segment. The temperature used for heat treatment of the web was 220° C. instead of 200° C. In other respects, the same procedure as in Example 12 was followed to obtain a nonwoven fabric. Despite the fact that high temperature was used for heat treatment, no evidence was seen of any thermal degradation of the polyester binder component.

COMPARATIVE EXAMPLE 4

Instead of the copolymerized polyester chips used in Example 13 were used copolymerized polyester chips (relative viscosity 1.97; melting point 95° C.) obtained by compounding 28 mol % of PET and PBT (molar ratio 6/4) as hard segment and 72 mol % of ϵ- CL as soft segment. Instead of heat treatment on a heated drum at 140° C. was carried out heat treatment on a heated drum at 80° C. Also, instead of heat treatment of the web at 180° C., the web was heat treated at 120° C. In other respects, the same procedure as in Example 13 was followed to obtain a nonwoven fabric.

Evaluation results are shown in Table 3 with respect to characteristic aspects of nonwoven fabrics, such as thickness, density, hand, and resistance to flattening, in Examples 12 to 16 and Comparative Example 4.

TABLE 3

| Example No. | Thickness (mm) | Density (g/cm³) | Soft Feel | Flattening Resistance C | Flattening Resistance Cp |
|---|---|---|---|---|---|
| 12 | 20 | 0.030 | 1 | 93 | 86 |
| 13 | 20 | 0.030 | 1 | 90 | 84 |
| 14 | 20 | 0.030 | 1 | 88 | 82 |
| 15 | 20 | 0.030 | 1 | 92 | 87 |
| 16 | 20 | 0.030 | 1 | 94 | 89 |
| Cmpr Ex 4 | 20 | 0.030 | 1 | 87 | 56 |

As is apparent from Table 3, nonwoven fabrics of Examples 12 to 16 were all found satisfactory in both soft feel and resistance to flattening. In contrast to this, nonwoven fabric of Comparative Example 4 was found unsatisfactory in resistance to flattening because the melting point of the polyester elastomer as the bonding component was low.

EXAMPLES 17, 18, 19, 20

For the purpose of varying densities of respective nonwoven fabrics to be obtained, the thickness of the spacer used in Example 12 to regulate web thickness during heat treatment was changed from 20 mm to 8 mm, 35 mm, and 69 mm (respectively for Examples 17, 18, and 19). The weight of web prior to heat treatment which was set at 600 g / m² in Example 12 was changed to 120 g / m², and the thickness of the spacer for regulating the thickness of the web during heat treatment was changed to 4 mm (for Example 20). In other respects, the same procedure as in Example 12 was followed to obtain respective nonwoven fabrics.

Evaluation results are shown in Table 4 with respect to characteristic aspects of nonwoven fabrics, such as thickness, density, soft feel, and resistance to flattening, in Examples 17, 18, 19 and 20.

As is apparent from Table 2, nonwoven fabrics of Examples 17 and 18 were found satisfactory in both soft feel and resistance to flattening. The nonwoven fabric of Example 19 which was lower in density was found to be somewhat liable to flatten but had satisfactory soft feel. The nonwoven fabric of Examples 20 which had a thickness of 4 mm seemed to give some feel of floor contact, but had satisfactory resistance to flattening.

TABLE 4

| Example No. | Thickness (mm) | Density (g/cm³) | Soft Feel | Flattening Resistance C | Flattening Resistance Cp |
|---|---|---|---|---|---|
| 17 | 8 | 0.081 | 1 | 100 | 96 |
| 18 | 35 | 0.019 | 1 | 88 | 84 |
| 19 | 69 | 0.009 | 1 | 70 | 67 |
| 20 | 4 | 0.030 | 2 | 92 | 89 |

What is claimed is:

1. A conjugate fiber comprising a polyester copolymer and polyethylene terephthalate, said polyester copolymer including ϵ-caprolactonee as a polyester component and said polyester copolymer having a melting point of not less than 100° C., wherein at least a portion of the surface of said fiber is composed of said polyester copolymer.

2. The fiber according to claim 1 wherein said conjugate fiber is a sheath-core with said polyester constituting the sheath and said PET constituting the core.

3. The fiber according claim 1 wherein said conjugate fiber is a side-by-side with said PET and polyester copolymer being in side-by-side arrangement.

4. The fiber according claim 1 wherein said conjugate fiber is a sea-island.

5. The fiber according to claim 1 wherein said conjugate fiber is a split-fiber.

6. A conjugate fiber comprising a polyester copolymer and polyethylene terephthalate, said polyester copolymer including ϵ-caprolactone as a polyester component and said polyester copolymer having a melting point of not less than 100° C., wherein at least a portion of the surface of said fiber is composed of said polyester copolymer; and wherein said conjugate fiber is one selected from the group consisting of sheath-core, side-by-side, sea-island, and split-fiber.

* * * * *